US005549944A

United States Patent [19]

Abate

[11] Patent Number: 5,549,944

[45] Date of Patent: Aug. 27, 1996

[54] TUBULAR ELEMENT FOR THE FORMATION OF BAGS FOR THE VACUUM-PACKING OF PRODUCTS

[76] Inventor: Luigi F. Abate, Via Colli Storici 67, S.Martino d/Battaglia (Brescia), Italy

[21] Appl. No.: 500,812

[22] Filed: Jul. 10, 1995

Related U.S. Application Data

[63] Continuation of Ser. No. 198,499, Feb. 18, 1994, abandoned.

[30] Foreign Application Priority Data

Oct. 13, 1993 [IT] Italy ..... BS930074 U

[51] Int. Cl.[6] ..... B65D 33/02; B65D 81/20

[52] U.S. Cl. ..... 428/35.2; 428/35.4; 428/35.7; 428/119; 428/178; 428/166; 428/200; 428/305.5; 428/476.1; 428/483; 428/516; 206/524.8; 383/119; 426/106; 426/127; 426/415

[58] Field of Search ..... 428/35.2, 35.4, 428/36.1, 475.8, 476.1, 483, 516, 517, 166, 178, 192, 200, 119, 305.5, 35.7; 206/524.8; 383/119; 426/106, 127, 316, 415

[56] References Cited

U.S. PATENT DOCUMENTS

| | | | |
|---|---|---|---|
| 2,778,173 | 1/1957 | Taunton | 206/524.8 |
| 3,595,722 | 7/1971 | Dawbarn | 383/119 |
| 4,104,404 | 8/1978 | Bieler et al. | 428/35.2 |
| 4,220,684 | 9/1980 | Olson | 428/35.2 |
| 4,401,256 | 8/1983 | Krieg | 428/35.2 |
| 5,075,143 | 12/1991 | Bekele | 428/35.2 |
| 5,134,001 | 7/1992 | Osgood | 428/35.2 |
| 5,234,731 | 8/1993 | Ferguson | 428/35.4 |

*Primary Examiner*—Ellis Robinson
*Assistant Examiner*—Rena L. Dye
*Attorney, Agent, or Firm*—McGlew and Tuttle, P.C.

[57] ABSTRACT

The present utility model pertains to a tubular element for the formation of bags for the vacuum-packing of products, on the inner surface of which is inserted a film (14) which is made of a thermo-plastic material and consists of a plurality of blisters or bubbles (15) intended for delimiting a network of surface channels (16) and for accommodating the nontoxic, insert gas to be progressively released into the bag for the preservation of the packed product.

10 Claims, 1 Drawing Sheet

TUBULAR ELEMENT FOR THE FORMATION OF BAGS FOR THE VACUUM-PACKING OF PRODUCTS

This is a continuation of application Ser. No. 08/198,499, filed Feb. 18, 1994, now abandoned.

FIELD OF THE INVENTION

The present invention pertains to packing materials, and more specifically, to tubular elements for the formation of bags which are impermeable, heat-sealable and intended for the vacuum-packing of perishable products.

BACKGROUND OF THE INVENTION

Packing materials in the shape of tubular elements, which are sealed longitudinally by means of bonding at least one side and are heat-sealable in the cross-sectional direction for use as bags, are already known. For the most part, the wall of the tubular element, which is produced from a folded sheet or front two overlapping sheets, consists of an outer layer or film which is made of a plastic material that is impermeable to gases and of at least one inner layer or film which is made of a thermoplastic material that is heat-sealable and compatible with the product to be packed.

The two layers or films are intimately connected, and the inner layer or film may have embossing, that is, a network of channels which promote the outlet of air for the formation of a vacuum in the bag at the time of the bag's sealing for use. However, the embossing only allows the evacuation of air for the vacuum-packing.

It is an object, the purpose of the present invention is to provide a packing material having a new, original design, which is obtained with a combination of various layers or films made of plastic material and with which two functions may be obtained at the same time within the scope of the resulting bag, with the impermeability towards the outside and the heat-sealability remaining constant:

the complete discharge of air for the formation of the vacuum;

the control of a nontoxic, inert gas which, when progressively released into the bag, permits the more prolonged preservation of the packed product, without having to resort to common preform compositions.

Another purpose of the present utility model is to provide a bag which consists of at least one inner surface formed by a film with blisters or bubbles which are capable of defining, among themselves, on the surface of the film, a network of channels for the evacuation of air and of containing the gas intended to be released into the bag in order to better preserve the packed product. According to the invention, a tubular element for the formation of bags for the vacuum-packing of products if provided including a first sheet formed of an outer layer of film which is made the material which is impermeable to gas and at least one inner layer of film which is made of a heat-sealable thermoplastic material. A similar second sheet is formed of an outer layer which is impermeable to gas and an inner layer which is made of a heat-sealable thermoplastic material. The first and second sheets are connected at an upper edge and a lower edge to form a tubular article. One of the inner layers is formed with a plurality of bubble structures which, when the first sheet is pressed against the second sheet, delimits a network of surface channels, defined between adjacent bubble structures. The bubble structures contain a non-toxic or inert gas to be progressively released into the bag for preservation of the packed product. In the case of an additional inner layer the additional inner layer is made of the same thermoplastic material as the inner layer of the first sheet and the inner layer of the second sheet.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
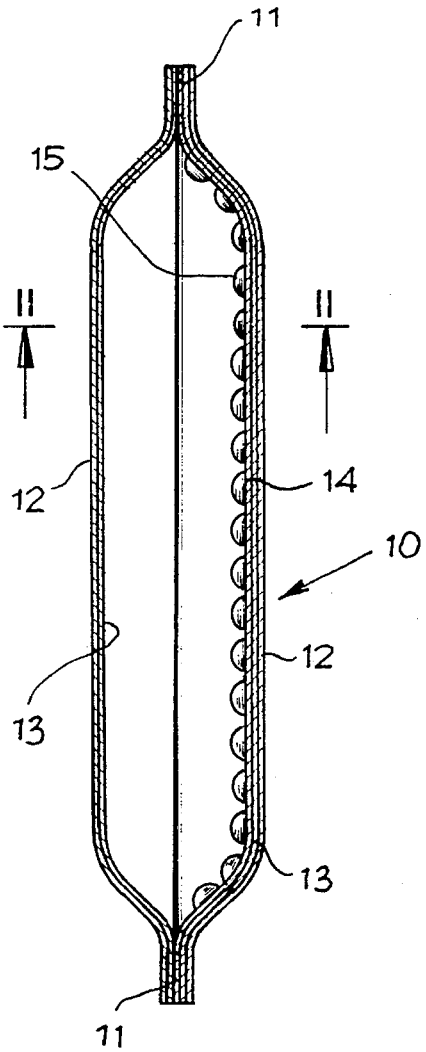
FIG. 1 is a cross-sectional view of a tubular element intended for forming a bag in accordance with the present utility model.

The tubular element under examination, indicated, as a whole, as 10 in FIG. 1, can be formed by a single folded sheet or by two over-lapping sheets and sealed in the longitudinal direction by means of bonding 11, along one side or two sides, respectively. The said tubular element 10 will thus be cut to the desired length, sealed ill the cross-sectional direction, by means of bonding, at one of its ends in order to form a bag and then sealed at the opposite end in order to seal the bag after having arranged the product to be packed and having formed the vacuum with appropriate means.

The sheet or sheets, which contribute to the formation of the said tubular element 10 and thus the formation of the said bag, consists or consist of an outer layer or film 12 made of an airtight material, that is, impermeable to gases, such as polyester, nylon, or the like, and of at least on inner layer or film 13 made of a thermo-plastic, heat-sealable material, such as polyethylene, polyethene, or the like. The said two layers or films 12, 13 are overlapped and intimately connected.

Figure 3:
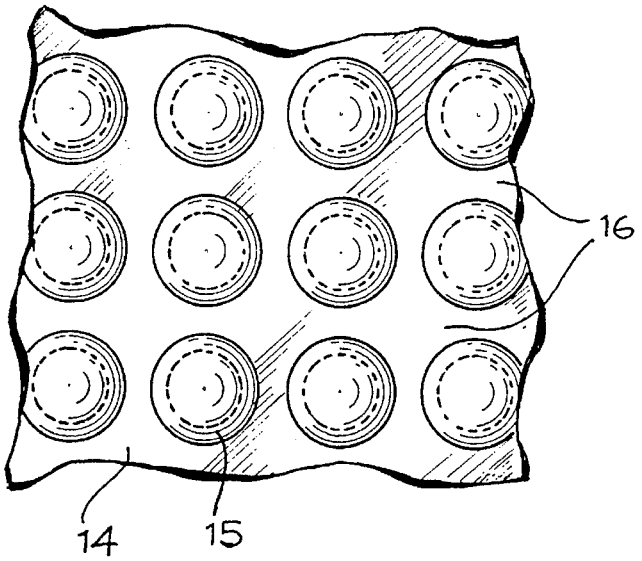
FIG. 3 is a plane view of the innermost film of the tubular element with bubbles.
Figure 2A:
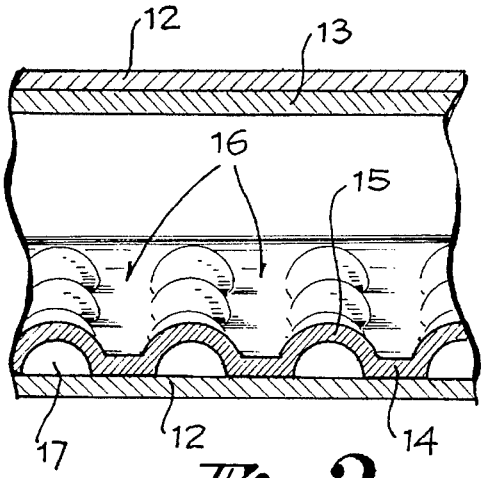
FIG. 2*a* is a view similar FIG. 2, showing a variant of a variant of the design.
Figure 2:
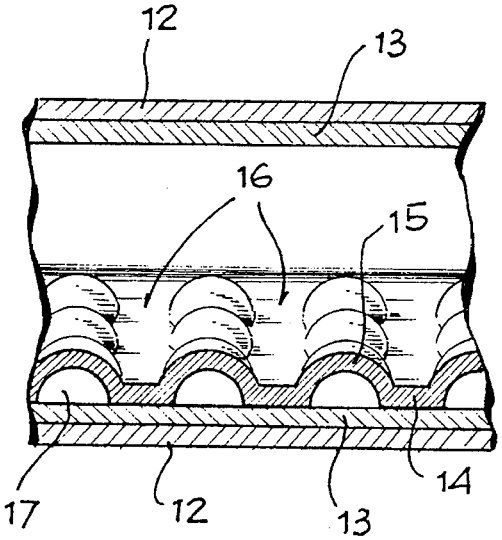
FIG. 2 is a partial longitudinal sectional view according to arrows II—II in FIG. 1.

On the said inner layer or film 13, which is made of a thermo-plastic material, is inserted a film 14 which is made of the same material, but which is preformed to define a plurality of blisters or bubbles 15, which is clearly shown in FIGS. 2 and 3. Such a film 14 with blisters or bubbles 15 is inserted in order to cover at least one inner surface, completely or partially, of the said tubular element 10, and thus to be in contact with the product placed in the resulting bag. However, nothing prevents the said film 14 from being able to be provided for covering both inner opposing surfaces of the said bag and from thus making all of the surfaces in contact with the said packed product.

In a variant such as shown in FIG. 2*a*, the said film 14 with blisters or bubbles may be inserted directly on the inner surface of the said outer film 12, thus eliminating the intermediate film 13.

The said blisters or bubbles 15 then have the twofold function of defining, among themselves, a network of surface channels 16, and of creating the same number of pockets for containing an inert gas for the preservation of the products.

The said network of channels 16 permits a complete evacuation of air from the said bag when the product is vacuum-packed. On the other hand, the gas contained in the said blisters or bubbles 17, in a state of rest, is essentially under atmospheric pressure. When the interior of the said bag is then depressed, the gas in the said bubbles 17 has a pressure that is greater than that in the said bag. Such a pressure in the said bubbles then produces the discharge of the said gas into the said bag through the microporosity formed by the inherent molecular network of the material (polyethene, polypropylene or the like), forming the film which defines the said bubbles. Through the action of the released gas, the restoration of the atmospheric pressure is thus obtained on the inside of the said bag with minimal variation in the volume of the latter and with the advantages:

of a reduction in the mechanical stresses on the bag; and with the outer pressure being equal to the inner pressure of the said bag, of eliminating any transfer of oxygen from the outside to the inside of the bag for a more prolonged preservation of the packed product.

What is claimed is:

1. A tubular element for forming bags used for the vacuum-packing of products, comprising: a first sheet formed of an outer layer of film made of a plastic material that is impermeable to gas and formed of an inner layer of film made of a thermoplastic, heat-sealable material; a second sheet formed of an outer layer of film made of a plastic material which is impermeable to gas and an inner layer of film made of a thermoplastic, heat-sealable material, said inner layer of said first sheet being bonded to said inner layer of said second sheet along an upper edge of said first sheet and said second sheet and along a lower edge of said first sheet and said second sheet, said edges extending in a length direction and said first sheet and said second sheet and said bonded edges cooperating to define a robe with an interior region for receiving the product to be vacuum packaged; a plurality of bubble structures formed on one of an inner surface of said inner layer of said first sheet, and an inner surface of said inner layer of said second sheet and an additional layer, said additional layer being formed of the same material as said inner layer of said first sheet and said inner layer of said second sheet, said additional layer being disposed on one of said inner layer of said first sheet and said inner layer of said second sheet, said bubble structures delimiting a network of surface channels covering at least half of an inner surface of the tubular element and defining passages between adjacent bubble structures when said first sheet is pressed against said second sheet for the discharge of air and for the formation of a vacuum in a formed bag, said bubble structures containing a nontoxic, inert gas which is provided in said passages after being progressively diffused from said bubble structures into the network of surface channels of the bag for the preservation of the packed product.

2. Tubular element according to claim 1, wherein said bubble structures are provided, spaced substantially an equal distance apart wherein a plurality of bubble structures cover an area extending between said lower edge and said upper edge.

3. Tubular element according to claim 1, wherein said additional film covers both said inner layer of said first sheet and said inner layer of said second sheet to provide opposed bubble structures in a resulting bag.

4. Tubular element according to claim 1, wherein said outer layer of film of each said first sheet and said second sheet is formed of one of nylon and polyester.

5. Tubular element according to claim 1, wherein said inner layer of film of each of said first sheet and said second sheet is formed of and polythene.

6. A tubular element for forming bags used for the vacuum-packing of products, comprising: a sheet formed of an outer layer of film made of a plastic material that is impermeable to gas and formed of an inner layer of film made of a thermoplastic, heat-sealable material, an edge of said inner layer of said sheet being bonded to another edge of said inner layer of said sheet said bonded edges cooperating to define a tube with an interior region for receiving the product to be vacuum packaged; a plurality of bubble structures formed on one of an inner surface of said inner layer of said sheet, and an additional layer, said additional layer being formed of the same material as said inner layer of said sheet, said additional layer being disposed on said inner surface of said sheet, said bubble structures delimiting a network of surface channels covering at least half of an inner surface of the tubular element and defining passages between adjacent bubble structures when the opposed portions of said inner surface are disposed proximate one another, for accommodating a nontoxic, inert gas to be progressively released into the bag for the preservation of the packed product.

7. Tubular element according to claim 6, wherein said bubble structures are provided, spaced substantially an equal distance apart wherein a plurality of bubble structures cover an area extending on one side of the tubular element.

8. Tubular element according to claim 6, wherein said additional film covers all of said inner surface.

9. Tubular element according to claim 6, wherein said outer layer of film of each of said first sheet and said second sheet is formed of one of nylon and polyester.

10. Tubular element according to claim 6, wherein said inner layer of film of each of said first sheet and said second sheet is formed of polyethylene.

* * * * *